United States Patent [19]

Nakamura et al.

[11] Patent Number: 4,610,239

[45] Date of Patent: Sep. 9, 1986

[54] CARTRIDGE-TYPE OIL TANK CONSTRUCTION

[75] Inventors: Kazuharu Nakamura, Nagoya; Yutaka Nakanishi, Kounan; Yoshiaki Hisada, Nagoya, all of Japan

[73] Assignee: Toyotomi Kogyo Co., Ltd., Aichi, Japan

[21] Appl. No.: 693,924

[22] Filed: Jan. 23, 1985

[30] Foreign Application Priority Data

Jan. 24, 1984 [JP] Japan ..... 59-8569[U]

[51] Int. Cl.[4] ..... F24C 5/04

[52] U.S. Cl. ..... 126/96; 431/320

[58] Field of Search ..... 431/64, 65, 320–324, 431/344; 126/96, 97, 45, 49; 222/187; 137/405, 320, 572; 141/21, 22, 319, 370, 372

[56] References Cited

U.S. PATENT DOCUMENTS 2,189,871 2/1940 Thomas ..... 126/96

FOREIGN PATENT DOCUMENTS 572552 11/1958 Belgium ..... 126/96
45-39587 12/1970 Japan ..... 431/64
0074523 5/1982 Japan ..... 431/320
833223 4/1960 United Kingdom ..... 126/96
908973 10/1962 United Kingdom ..... 126/96

*Primary Examiner*—Margaret A. Focarino
*Attorney, Agent, or Firm*—Pollock, Vande Sande & Priddy

[57] ABSTRACT

A cartridge-type oil tank construction is disclosed which is capable of effectively preventing oil leakage from the construction even when the construction falls down in any direction. The oil tank construction includes a stationary tank, an integrally formed tank supporting means arranged near one side end of the stationary tank to dispose a cartridge tank therethrough on the stationary tank, and a combination of a projection and a cutout which serves to allow an oil supply port of the tank supporting means to constantly face the other side end of the stationary tank opposite to the one side end thereof.

16 Claims, 4 Drawing Figures

CARTRIDGE-TYPE OIL TANK CONSTRUCTION

BACKGROUND OF THE INVENTION

1. Field of the Invention

This invention relates to a cartridge-type oil tank construction, and more particularly a cartridge-type oil tank construction which is capable of minimizing or substantially preventing the leakage of oil when it falls down.

2. Description of the Prior Art

Conventionally, a cartridge-type oil tank construction comprising a cartridge tank and a flat auxiliary or stationary tank has been advantageously used for the reason that it can significantly decrease the amount of oil to be received in the auxiliary oil tank, to thereby minimize or substantially prevent the leakage of oil, for example, through an opening provided at a cover plate of the auxiliary oil tank when it falls down.

Recently, it has been highly desired to decrease the overall size of an article for which an oil tank is to be used, such as an oil burner. This requires that an oil tank is installed at the end of the article. However, in the conventionally cartridge-type oil tank construction, this often causes a large amount of oil to be leaked from the flat auxiliary or stationary tank through the opening formed at the upper or cover plate of the stationary tank when the article falls down in a manner such that the opening is downward positioned, because an oil level in the stationary tank is above the opening.

Accordingly, it would be highly desired to develop a cartridge-type oil tank construction which is capable of minimizing or substantially prevent the oil leakage from the oil tank construction even when it falls down in any direction.

SUMMARY OF THE INVENTION

The present invention has been made in view of the foregoing disadvantage of the prior art.

In accordance with the present invention, there is provided a cartridge-type oil tank construction comprising an oil tank means having an opening formed at the portion of the upper wall thereof in the vicinity of one side end thereof; a tank supporting means detachably mounted through said opening with respect to said oil tank means, said tank supporting means having an oil supply port formed at the side portion thereof; a positioning means for positioning said oil supply port of said tank supporting means so that it may face to the other side end of said oil tank means opposite to said one side end thereof when said tank supporting means is mounted through said opening with respect to said oil tank means; and a cartridge tank having a valved cap, said cartridge tank being invertedly supported on said oil tank means through said tank supporting means so that oil is fed from said cartridge tank through a valve of said cap and said oil supply port of said tank supporting means to said oil tank means; said oil tank means being adapted to allow an oil level in said oil tank means obtained when said oil tank construction falls down in the direction of said one side end of said oil tank means to be substantially lower than said oil supply port of said tank supporting means, so that said oil supply port of said tank supporting means may be constantly above an oil level in said oil tank means when said oil tank construction falls down in any direction.

In accordance with the present invention, there is also provided a cartridge-type oil tank construction comprising an oil tank means having an opening formed at the portion of the upper wall thereof in the vicinity of one side end thereof; a tank supporting means detachably mounted through said opening with respect to said oil tank means and having an oil supply port formed at the side portion thereof; a cartridge tank having a valved cap, said cartridge tank being invertedly supported on said oil tank means through said tank supporting means so that oil is fed from said cartridge tank through a valve of said cap and said oil supply port of said tank supporting means to said oil tank means; said tank supporting means comprising a portion engaged with said opening of said oil tank means, an inner vessel downward extending from said engaged portion and provided with a filter means and an actuating means for actuating said valve of said cap of said cartridge tank and an outer vessel downward extending from said engaged portion to surround said inner vessel with a space being defined between said inner and outer vessels so as to act as an il reservoir; said oil supply port comprising an opening provided at the side wall of said outer vessel; a positioning means comprising a projection provided on said outer vessel from said tank supporting means so as to extend from said engaged portion to the vicinity of the lower end of said outer vessel of said tank supporting means and a cutout formed at the periphery of said opening of said oil tank means, said projection and cutout being engaged together to position said oil supply port of said tank supporting means so that it may face to the other side end of said oil tank means opposite to said one side thereof when said tank supporting means is mounted with respect to said oil tank means; said oil tank means being adapted to allow an oil level in said oil tank means obtained when said oil tank construction falls down in the direction of said one side end of said oil tank means to be substantially lower than said oil supply port of said tank supporting means, so that said oil supply port of said tank supporting means may be constantly above an oil level in said oil tank means when said oil tank construction falls down in any direction.

Further, in accordance with the present invention, there is provided a cartridge-type oil tank construction for an oil burner comprising a stationary tank arranged to laterally extend from a burner body of said oil burner and having an opening formed at the portion of the upper wall thereof in the vicinity of the distal end thereof; a tank supporting means detachably mounted through said opening with respect to said stationary tank and having an oil supply port formed at the side portion thereof; a cartridge tank having a valved cap and invertedly supported on said stationary tank through said tank supporting means so that oil is fed from said cartridge tank through a valve of said cap and said oil supply port of said tank supporting means to said stationary tank; said tank supporting means comprising an upper flange securely supporting on the periphery of said opening of said stationary tank, an inner vessel downward extending from said supported portion and provided with a filter means and a push pin for actuating said valve of said cap of said cartridge tank and an outer vessel downward extending from said supported portion to surround said inner vessel with a space being defined between said inner and outer vessels so as to act as an oil reservoir; said oil supply port comprising an opening formed at the side wall of said outer vessel; a positioning means comprising a projection provided on said outer vessel from said tank supporting means so as to extend from said flange to the vicinity of the lower end of said outer vessel of said tank supporting means and a cutout formed at the periphery of said opening of said stationary tank, said projection and cutout being engaged together to position said oil supply port of said tank supporting means so that it may constantly face to said burner body of said oil burner when said tank supporting means is mounted with respect to said stationary tank; said stationary tank being adapted to allow an oil level therein obtained when said oil burner falls down in the direction of said distal end of said stationary tank to be substantially lower than said oil supply port of said tank supporting means, so that said oil supply port of said tank supporting means may be constantly above an oil level in said stationary tank when said oil burner falls down in any direction.

Accordingly, it is an object of the present invention to provide a cartridge-type oil tank construction which is capable of effectively minimizing the leakage of oil from the oil tank construction when it falls down in any direction.

It is another object of the present invention to provide a cartridge-type oil tank construction which is capable of substantially preventing the oil leakage from the oil tank construction when it falls down in any direction.

It is another object of the present invention to provide a cartridge-type oil tank construction which is capable of carrying out the above-mentioned objects with a simple structure.

It is a further object of the present invention to provide a cartridge-type oil tank construction which is capable of readily carrying out the cleaning.

It is still a further object of the present invention to provide a cartridge-type oil tank construction for an oil burner such as an oil-fired space heater which is capable of effectively minimizing or substantially preventing the oil leakage from the oil tank construction even when the oil burner falls down in any direction.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals indicate like or corresponding parts throughout, wherein.

DETAILED DESCRIPTION OF THE PREFERRED EMBODIMENT

Now, a cartridge-type oil tank construction according to the present invention will be described hereinafter with reference to the accompanying drawings.

Figure 1:
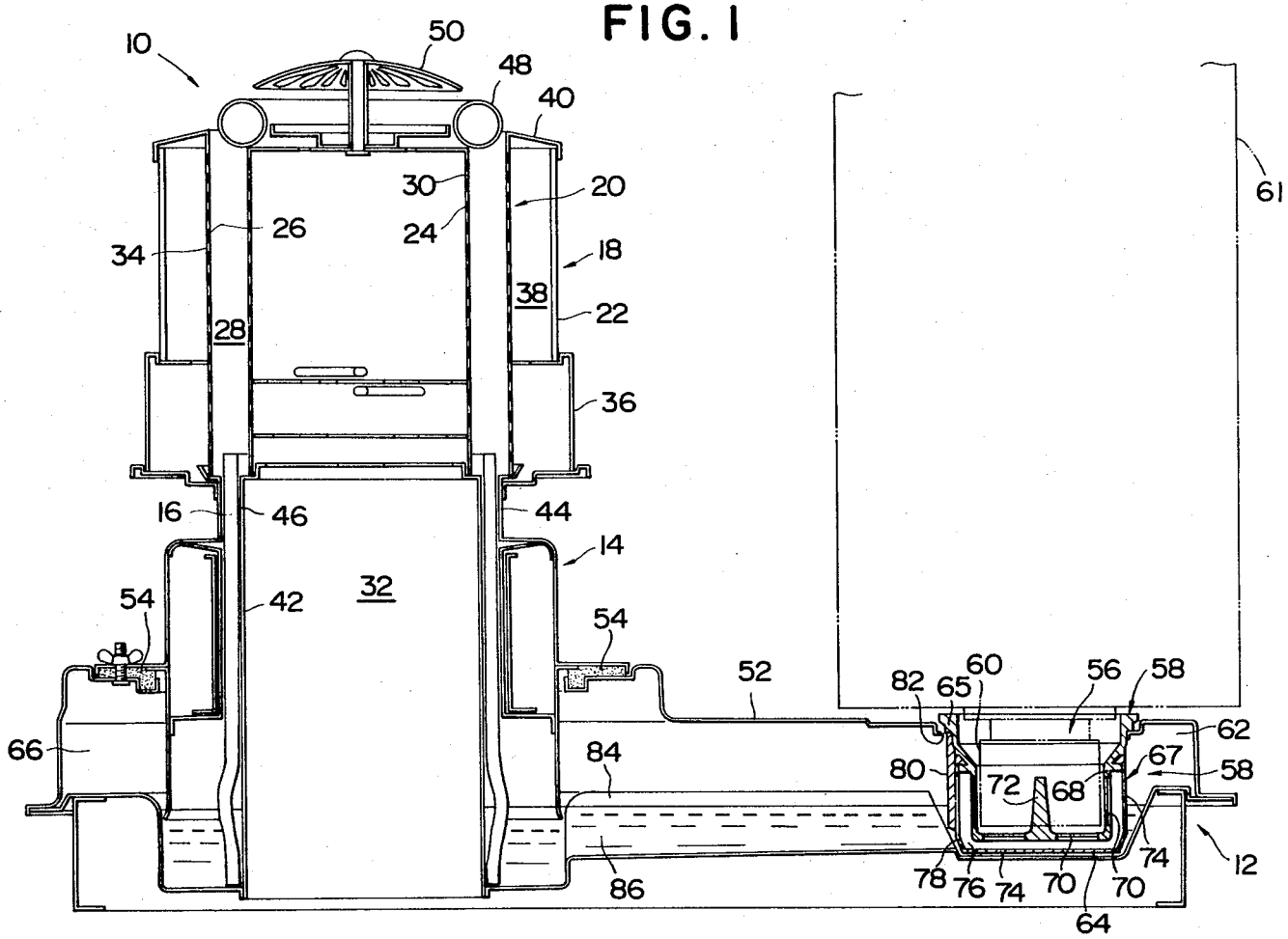
FIG. 1 is a schematic vertical sectional view showing one embodiment of a cartridge-type oil tank construction according to the present invention which is used for an oil-fired space heater.
Figure 2:
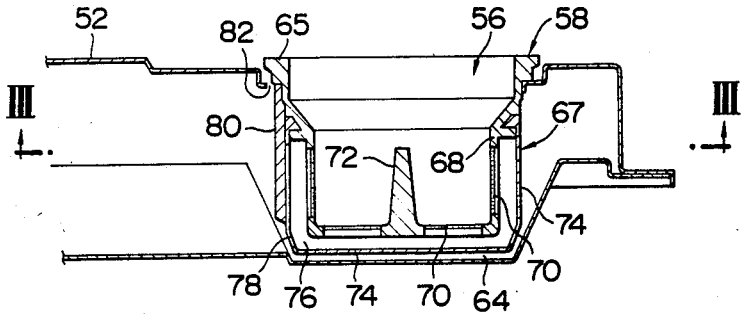
FIG. 2 is an enlarged sectional view showing the essential part of the cartridge-type oil tank construction of FIG. 1.

FIG. 1 shows an oil burner in which an embodiment of a cartridge-type oil tank construction according to the present invention is incorporated. However, it should be understood that the cartridge-type oil tank construction of the present invention is used for an article other than such an oil burner.

Prior to describing a cartridge-type oil tank construction according to the present invention, the oil burner generally designated by reference numeral 10 in FIG. 1 will be described.

The oil burner 10 is constructed in a manner widely known in the art, except a cartridge-type oil tank construction 12 of the present invention incorporated therein. The oil burner 10 takes the form of a wick-ignition type red-heated oil fired-space heater and includes a wick receiving cylinder 14 which is adapted to receive a wick 16 therein and communicated with the oil tank construction 12. The wick receiving cylinder 14 is oil-tightly constructed so as to prevent oil from leaking therefrom to the outside.

The oil burner 10 also includes a combustion cylinder construction 18 arranged on the wick receiving cylinder 14. The combustion cylinder construction 18 comprises a double combustion cylinder 20 and a heat-permeable cylinder 22 substantially concentrically arranged at the outside of the double combustion cylinder 20. The double combustion cylinder 20 comprises an inner cylindrical member 24 and an outer cylindrical member 26 arranged to be substantially concentrical with the inner cylindrical member 26 with a space 28 of a suitable interval being defined therebetween. The inner cylindrical member 24 is formed with a plurality of through-holes 30 which serve to supply a part of combustion air therethrough to the space 28 from a cylindrical internal space 32 defined in the double combustion cylinder 20 and communicated through the bottom of a burner body with the exterior of the burner. Also, the outer cylindrical member 26 is formed with a plurality of through-holes 34. The heat-permeable cylinder 22 arranged at the outside of the double combustion cylinder 20 is formed of, for example, a transparent or translucent and heat-resistant glass and supported through a non-permeable base cylinder 36 on the wick receiving cylinder 14. In the example illustrated, the heat-permeable cylinder 22 is single. However, it may comprises an upper cylinder member and a lower cylinder member vertically separated from each other. The heat-permeable cylinder 22 is arranged to surround the double combustion cylinder 20 with a space 38 of a suitable interval being defined therebetween and serves to discharge heat rays emitted from the double combustion cylinder 20 red-heated due to combustion carried out in the space 28 and probably at the outside of the outer cylindrical member 26 therethrough to the outside of the burner. The space 38 is closed at the upper end thereof with a top plate 40 of the outer cylindrical member 26.

The wick receiving cylinder 14 has an inner wall 42 and an outer wall 44 which are arranged to define therebetween an annular wick receiving chamber 46 communicated with the space 28 between the inner and outer cylindrical members 24 and 26 of the double combustion cylinder 20. When combustion is to be carried out, the wick 16, as shown in FIG. 1, is raised to the lower portion of the space 28 by means of a wick actuating mechanism (not shown).

Reference numeral 48 designates a coil formed of metal which is red-heated due to combustion heat generated from the space 28 during the combustion operation, and reference numeral 50 designates a cover plate arranged above the internal space 32.

The cartridge-type oil tank construction 12 of the illustrated embodiment includes a flat and shallow stationary tank 52 communicated with the wick receiving chamber 46. The stationary tank 52 is formed into a substantially rectangular shape and arranged to surround the lower half of the wick receiving cylinder 14. More particularly, in the illustrated embodiment, the stationary tank 52 is formed into a laterally elongated shape or laterally extends from the wick receiving cylinder 46. The stationary tank 52 is oil-sealedly or oil-tightly mounted with respect to the wick receiving cylinder 14 by means of an oil-sealing fixture 54 to prevent oil leakage from the connection between the stationary tank 52 and the wick receiving cylinder 14 to the outside. The stationary tank 52 is formed at the upper wall thereof near the outward extending end thereof with an opening 56, in which an integrally formed tank supporting means 58 of a double vessel structure is rigidly and detachably fitted. The opening 56 is formed at the substantially middle position along the transverse direction of the stationary tank 52. The tank supporting means 58 serves to receive a valved cap 60 of a cartridge tank 61 to support the cartridge tank 61 therethrough on the stationary tank 52.

In the illustrated embodiment, the stationary tank 52 is formed to have a volume which allows an oil level in the tank 52 obtained when the oil burner 10 falls down in the forward or rearward direction in FIG. 1 to be substantially lower than the middle portion of the tank supporting means 58 or reach at most the lower portion of the tank receiving means 58, as in a conventional stationary tank. Also, the stationary tank 52 is constructed to allow an oil level therein obtained when the oil burner 10 falls down on the oil tank side or the right side in FIG. 1 to be substantially lower than the upper portion of the tank supporting means 58 or reach at most the middle portion of the receiving means 58. In the illustrated embodiment, this is accomplished by the cooperation of a chamber 62 formed at the outside of the tank receiving means 58 and a bottom recess 64 formed at the portion of the stationary tank in which an oil reservoir described hereinafter is received. Alternatively, this may be carried out by only the chamber 62. The stationary tank 52 is also provided at the portion thereof positioned on the outside of the wick receiving cylinder 14 with another chamber 66 which serves to substantially receive therein fuel oil of the stationary tank 52 when the oil burner falls down on the burner body side or on the left side in FIG. 1.

Figure 4:
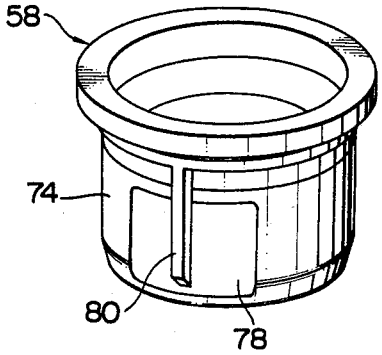
FIG. 4 is a perspective view showing a cartridge-tank receiving means in the cartridge-type oil tank construction shown in FIG. 1.

The tank supporting means 58 of a double vessel structure is integrally formed as described above and constructed in a manner to be detachably mounted through the opening 56 with respect to the stationary tank 52. More particularly, the tank supporting means 58 has an upper flange 65 adapted to be securely rested on the upper wall of the stationary tank 52 and a double vessel portion 67 inserted through the opening 56 in the stationary tank 52 and generally formed into a shape which allows the valved-cap 60 of the cartridge tank 61 to be received therein, as shown in FIG. 4. The tank supporting means 58 is received at the lower portion of the double vessel portion 67 in the bottom recess 64 of the tank 52.

The double vessel portion 67 of the tank supporting means 58 includes an inner vessel 68 provided with a filter means 70 which serves to filter out the dart of fuel oil supplied from the cartridge tank to the stationary tank. The inner vessel 68 of the double vessel portion 67 is also provided at the bottom wall thereof with an upward extending push pin 72 which acts to open a valve of the cap 60 to allow fuel oil to flow therethrough from the cartridge tank 61 to the stationary tank 52 when the cap 60 is received therein. The double vessel portion 67 also includes an outer vessel 74 integrated at the upper end thereof with the upper end of the inner vessel 68 and arranged to surround the inner vessel 68 with a space 76 being defined between the inner vessel 68 and the outer vessel 74 which serves as an oil reservoir. The outer vessel 74 has a through-hole or opening 78 formed at the side portion thereof facing the wick receiving cylinder 14 which serves as an oil supply port. The oil reservoir or space 76 is communicated through only the through-hole or opening 78 with the stationary tank 52. The through-hole or opening 78, as shown in FIG. 1, is positionally formed at the height constantly hidden by fuel oil received in the stationary tank.

The tank supporting means 58 is formed on the outer surface thereof with a elongated projection 80 downward extending from the upper flange portion thereof to the vicinity of the bottom portion thereof, and correspondingly the periphery of the opening 56 formed at the upper wall of the stationary tank 52 is formed with a cutout 82. The cutout 82 is positionally aligned with the projection 80 to receive the projection 80 therein when the tank supporting means 58 is received through the opening 56 in the stationary tank 52, so that the tank supporting means 58 may be disposed at the same position with respect to the opening 56 to allow the through-hole or opening 78 of the outer vessel 74 to constantly face the wick receiving cylinder 14. In the illustrated embodiment, the projection 80 and cutout 82 are provided with the tank supporting means 58 and the stationary tank 52, respectively. However, the projection 80 and cutout 82 may be provided with the stationary tank 52 and tank supporting means 58, respectively.

Reference numeral 84 designates a pair of protrusions laterally extending from the bottom recess 64 to the wick receiving cylinder 14 in parallel with each other with a trough 86 of a suitable width being defined therebeween which acts to guide fuel oil from the oil reservoir 76 to the wick receiving cylinder 14. The protrusions 84 also serve to keep fuel oil in the stationary tank 52 at a predetermined level or limit the volume of the stationary tank 52 to prevent excessive fuel oil from being received in the stationary tank 52.

The manner of operation of the cartridge-type oil tank construction of the illustrated embodiment constructed in the manner as described above will be described hereinafter.

When the cartridge tank charged with fuel oil is invertedly supported through the valved cap 60 and tank supporting means 58 on the stationary tank 52, the valve of the cap 60 is opened by the push pin 72 to allow fuel oil to flow from the cartridge tank 61 through the filter means 70 of the inner vessel 68 to the space or oil reservoir 76. Then, fuel oil is supplied from the space 76 through the oil supply port or opening 78 to the interior of the stationary tank 52 and further through the trough 86 to the wick receiving cylinder 14. The supply of fuel oil from the cartridge tank 61 to the stationary tank 52 is stopped when fuel oil in the stationary tank 52 reaches a predetermined level as shown in FIG. 1 to cause the quantity of fuel oil in the stationary tank to be kept substantially constant.

In the cartridge-type oil tank construction 12 of the illustrated embodiment, the tank supporting means 58 has the outer vessel 74 formed with the opening 78 which is adapted to constantly face the wick receiving cylinder 14 due to the cooperation between the projection 80 and the cutout 82 when the tank supporting means 58 is fitted in the opening 56 of the stationary tank 52. Thus, even when the oil burner 10 falls down in the right direction in FIG. 1 to cause fuel oil in the stationary tank 52 to vigorously wave, the construction 12 does not cause the fuel oil to substantially to reach the level of the opening 78 as shown in FIG. 3, to thereby effectively prevent fuel oil in the stationary tank 52 from leaking through the construction to the outside.

Figure 3:
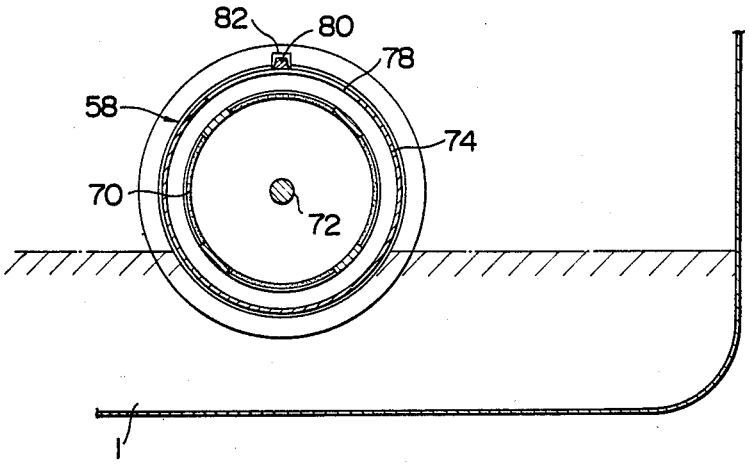
FIG. 3 is a cross-sectional view taken along line III—III of FIG. 2.

In the case that an oil level in the stationary tank 52 obtained when the oil burner falls down in the direction of the cartridge tank or in the right direction in FIG. 1 reaches the opening 56 depending upon the stationary tank as shown in FIG. 3, there is a fear that oil leaks through the connection between the flange portion 65 of the tank supporting means 58 and the periphery of the opening 56 to the outside. In order to avoid such a problem, a suitable oil-sealing means such as a packing, an O-ring or the like may be arranged between the flange portion 65 and the periphery of the opening 56.

Conventionally, a stationary tank such as the tank 52 in the embodiment often causes dirt, water and the like to get thereinto, however, a conventional oil tank construction renders the cleaning operation of the stationary tank highly difficult and troublesome because it is required to disassemble the construction. On the contrary, in the cartridge-type oil tank construction of the illustrated embodiment, the tank supporting means 58 is detachably mounted with respect to the stationary tank 52, so that the cleaning of the tank supporting means 58 and stationary tank may be readily accomplished.

Further, in the cartridge-type oil tank construction of the illustrated embodiment, the mounting of the tank supporting means 58 with respect to the stationary tank is carried out by the cooperation between the projection 80 and the cutout 82, resulting in the opening 78 of the outer vessel 74 constantly facing the wick receiving cylinder 14. This can be more effectively accomplished by extending the projection 80 from the upper flange portion 65 of the tank supporting means 58 to the vicinity of the bottom portion thereof as in the illustrated embodiment.

It will thus be seen that the objects set forth above, and those made apparent from the preceding description, are efficiently attained and. since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A cartridge-type oil tank construction comprising:

an oil tank means having an opening formed at the portion of the upper wall thereof in the vicinity of one side end thereof;

a tank supporting means having an oil supply port formed at a side portion thereof and including means for invertedly supporting on said oil tank means a cartridge tank having a valved cap so that oil is fed from said cartridge tank through a valve of said cap and said oil supply port of said tank supporting means to said oil tank means, means for detachably mounting said tank supporting means through said opening with respect to said oil tank means; and, positioning means for positioning said oil supply port of said tank supporting means so that it faces the other side end of said oil tank means opposite to said one side end thereof when said tank supporting means is mounted through said opening with respect to said oil tank means;

said oil tank means further including a chamber provided at the outside of said tank supporting means for receiving a volume of oil sufficient to allow an oil level in said oil tank means obtained when said oil tank construction falls down in the direction of said one side end of said oil tank means to be substantially lower than said oil supply port of said tank supporting means.

2. A cartridge-type oil tank construction as defined in claim 1, wherein said tank supporting means comprises a portion engaged with said opening of said oil tank means to support said oil tank means with respect to said tank supporting means, an inner vessel downward extending from said engaged portion and provided with a filter means and an actuating means for actuating said valve of said cap of said cartridge tank and an outer vessel downward extending from said engaged portion to surround said inner vessel with a space being defined between said inner and outer vessels so as to act as an oil reservoir.

3. A cartridge-type oil tank construction as defined in claim 2, wherein said inner vessel and said outer vessel of said tank supporting means are integrally formed.

4. A cartridge-type oil tank construction as defined in claim 2, wherein said oil supply port comprises an opening provided at the side wall of said outer vessel.

5. A cartridge-type oil tank construction as defined in claim 1, wherein said positioning means comprises a projection provided at said tank supporting means and a cutout formed at the periphery of said opening of said oil tank means to be engaged with said projection.

6. A cartridge-type oil tank construction as defined in claim 1, wherein said positioning means comprises a projection provided at the periphery of said opening of said oil tank means and a cutout formed at said tank supporting means to be engaged with said projection.

7. A cartridge-type oil tank construction as defined in claim 5, wherein said positioning means comprises a projection provided on said outer vessel so as to extend from said engaged portion to the vicinity of the lower end of said outer vessel and a cutout formed at the periphery of said opening of said oil tank means.

8. A cartridge-type oil tank construction as defined in claim 1, wherein said oil tank means further includes a bottom recess in which a portion of said tank supporting means is received.

9. A cartridge-type oil tank construction as defined in claim 1, wherein said oil tank means is formed to have a volume which allows said oil supply port of said tank supporting means to be constantly above an oil level in said oil tank means when said oil tank construction falls down in any direction.

10. A cartridge-type oil tank construction as defined in claim 9, wherein said oil tank means extends laterally from a wick receiving cylinder to said one side end thereof and further includes another chamber which is provided at a portion of said oil tank means positioned on the outside of said wick receiving cylinder to receive oil therein when said oil tank construction falls down in the direction of said other side end of said oil tank means opposite to said one side end thereof.

11. A cartridge-type oil tank construction comprising:

an oil tank means having an opening formed at the portion of the upper wall thereof in the vicinity of one side end thereof;

a tank supporting means detachably mounted through said opening with respect to said oil tank means and having an oil supply port formed at the side portion thereof;

a cartridge tank having a valved cap, said cartridge being invertedly supported on said oil tank means through said tank supporting means so that oil is fed from said cartridge tank through a valve of said cap and said oil supply port of said tank supporting means to said oil tank means;

said tank supporting means comprising a portion engaged with said opening of said oil tank means, an inner vessel downward extending from said engaged portion and provided with a filter means and an actuating means for actuating said valve of said cap of said cartridge tank and an outer vessel downward extending from said engaged portion to surround said inner vessel with a space being defined between said inner and outer vessels so as to act as an oil reservoir;

said oil supply port comprising an opening provided at the side wall of said outer vessel; and, a positioning means comprising a projection provided on said outer vessel of said tank supporting means so as to extend from said engaged portion to the vicinity of the lower end of said outer vessel of said tank supporting means and a cutout formed at the periphery of said opening of said oil tank means, said projection and cutout being engaged together to position said oil supply port of said tank supporting means so that it faces the other side end of said oil tank means opposite to said one side end thereof when said tank supporting means is mounted with respect to said oil tank means;

said oil tank means further including a chamber provided at the outside of said tank supporting means for receiving a volume of oil sufficient to allow an oil level in said oil tank means obtained when said oil tank construction falls down in the direction of said one side end of said oil tank means to be substantially lower than said oil supply port of said tank supporting means.

12. A cartridge-type oil tank construction as defined in claim 11, wherein said oil tank means is formed to have a volume which allows said oil supply port of said tank supporting means to be constantly above an oil level in said oil tank means when said oil tank construction falls down in any direction.

13. A cartridge-type oil tank construction as defined in claim 12, wherein said oil tank means extends laterally from a wick receiving cylinder to said one side end thereof and further includes another chamber which is provided at a portion of said oil tank means positioned on the outside of said wick receiving cylinder to receive oil therein when said oil tank construction falls down in the direction of said other side end of said oil tank means opposite to said one side end thereof.

14. A cartridge-type oil tank construction for an oil burner comprising:

a stationary tank arranged to laterally extend from a burner body of said oil burner and having an opening formed at the portion of the upper wall thereof in the vicinity of the distal end thereof;

a tank supporting means detachably mounted through said opening with respect to said stationary tank and having an oil supply port formed at the side portion thereof;

a cartridge tank having a valved cap and invertedly supported on said stationary tank through said tank supporting means so that oil is fed from said cartridge tank through a valve of said cap and said oil supply port of said tank supporting means to said stationary tank;

said tank supporting means comprising an upper flange securely supported on the periphery of said opening of said stationary tank, an inner vessel downward extending from said supported portion and provided with a filter means and a push pin for actuating said valve of said cap of said cartridge tank and an outer vessel downward extending from said supported portion to surround said inner vessel with a space being defined between said inner and outer vessels so as to act as an oil reservoir;

said oil supply port comprising an opening formed at the side wall of said outer vessel; and, a positioning means comprising a projection provided on said outer vessel of said tank supporting means so as to extend from said flange to the vicinity of the lower end of said outer vessel of said tank supporting means and a cutout formed at the periphery of said opening of said stationary tank, said projection and cutout being engaged together to position said oil supply portion of said tank supporting means so that it constantly faces said burner body of said oil burner when said tank supporting means is mounted with respect to said stationary tank;

said stationary tank further including a chamber provided at the outside of said tank supporting means for receiving a volume of oil sufficient to allow an oil level therein obtained when said oil burner falls downs in the direction of said distal end of said stationary tank to be substantially lower than said oil supply port of said tank supporting means.

15. A cartridge-type oil tank construction as defined in claim 14, wherein said oil tank means is formed to have a volume which allows said oil supply port of said tank supporting means to be constantly above an oil level in said oil tank means when said oil tank construction falls down in any direction.

16. A cartridge-type oil tank construction as defined in claim 15, wherein said oil tank means extends laterally from a wick receiving cylinder to said one side end thereof and further includes another chamber which is provided at a portion of said oil tank means positioned on the outside of said wick receiving cylinder to receive oil therein when said oil tank construction falls down in the direction of said other side end of said oil tank means opposite to said one side end thereof.

* * * * *